US008312832B1

(12) United States Patent
Camp

(10) Patent No.: US 8,312,832 B1
(45) Date of Patent: Nov. 20, 2012

(54) BOAT ANCHORING SYSTEM

(76) Inventor: Alan Camp, Palm Harbor, FL (US)

( * ) Notice: Subject to any disclaimer, the term of this patent is extended or adjusted under 35 U.S.C. 154(b) by 407 days.

(21) Appl. No.: 12/660,974

(22) Filed: Mar. 8, 2010

(51) Int. Cl.
*B63B 21/26* (2006.01)

(52) U.S. Cl. ..... 114/295; 52/155; 114/294

(58) Field of Classification Search ..... 114/230.1, 114/230.13, 230.15, 230.2, 293, 294, 295; 52/155, 156, 157
See application file for complete search history.

(56) References Cited

U.S. PATENT DOCUMENTS 4,702,047 A 10/1987 Stokes
5,240,353 A * 8/1993 Bower et al. ..... 52/157
6,041,730 A 3/2000 Oliverio
6,305,882 B1 10/2001 Coast
7,870,829 B1 * 1/2011 Perry et al. ..... 114/230.1
* cited by examiner

*Primary Examiner* — Lars A Olson

(57) ABSTRACT

A cylindrical rod has an upper end with an upper aperture, a lower end with a lower aperture, and is of a common diameter along the majority of its length. A spiral attachment component has an upwardly facing upper end received in the lower aperture and a downwardly facing lower end terminating in a point. A crank has a vertical lower region removably received in the upper aperture, a horizontal middle region, and a vertical upper region. A cylindrical collar is secured to the lower region of the crank. The collar has a central recess of a diameter less than the diameter of the collar. A rope has a first end secured around the central recess of the collar and a second end adapted to be secured to a cleat of a boat.

5 Claims, 2 Drawing Sheets

FIG 1
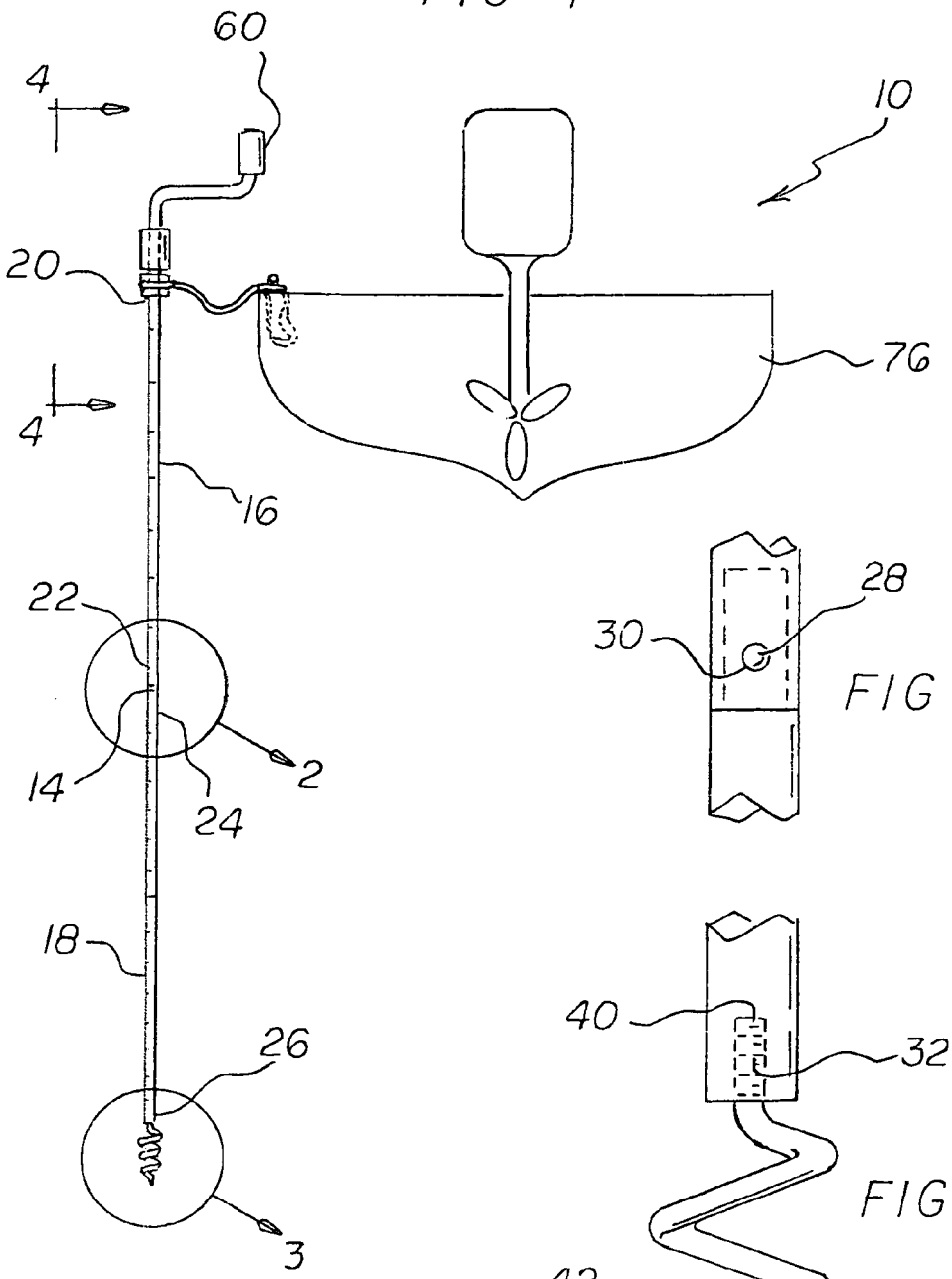
FIG 2
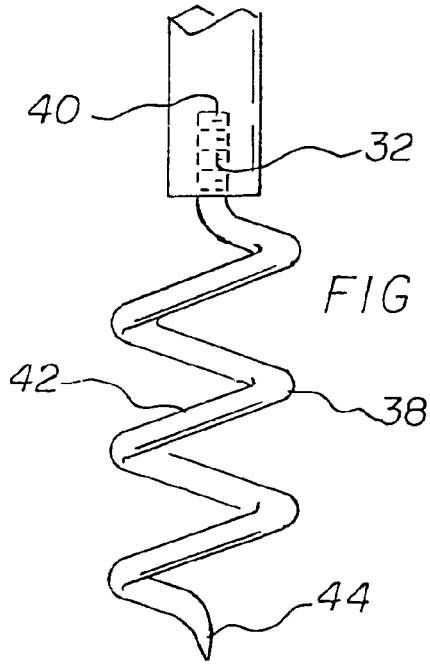
FIG 3

BOAT ANCHORING SYSTEM

BACKGROUND OF THE INVENTION

1. Field of the Invention

The present invention relates to a boat anchoring system and more particularly pertains to securing the location of a boat in water as for fishing and the like, the securing being done in a safe, reliable and economical manner.

2. Description of the Prior Art

The use of boat anchoring systems and known designs and configurations is known in the prior art. More specifically, boat anchoring systems and known designs and configurations previously devised and utilized for the purpose of anchoring boats are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,702,047 issued Oct. 27, 1987 to Stokes relates to Ground Anchors. U.S. Pat. No. 6,041,730 issued Mar. 28, 2000 to Oliverio relates to a Shallow Water Anchor. Lastly, U.S. Pat. No. 6,315,882 issued Oct. 23, 2001 to Coast relates to Apparatus for Placing Auger Type Anchors.

While these devices fulfill their respective, particular objectives and requirements, the aforementioned patents do not describe a boat anchoring system that allows securing the location of a boat in water as for fishing and the like, the securing being done in a safe, reliable and economical manner.

In this respect, the boat anchoring system according to the present invention substantially departs from the conventional concepts and designs of the prior art, and in doing so provides an apparatus primarily developed for the purpose of securing the location of a boat in water as for fishing and the like, the securing being done in a safe, reliable and economical manner.

Therefore, it can be appreciated that there exists a continuing need for a new and improved boat anchoring system which can be used for securing the location of a boat in water as for fishing and the like, the securing being done in a safe, reliable and economical manner. In this regard, the present invention substantially fulfills this need.

SUMMARY OF THE INVENTION

In view of the foregoing disadvantages inherent in the known types of boat anchoring systems and known designs and configurations now present in the prior art, the present invention provides an improved boat anchoring system. As such, the general purpose of the present invention, which will be described subsequently in greater detail, is to provide a new and improved boat anchoring system and method which has all the advantages of the prior art and none of the disadvantages.

To attain this, the present invention essentially comprises an elongated linear rod formed of a common diameter along a vertical axis. The linear rod includes an upper section and a lower section. The upper section has an upper end and a lower end. The lower section has an upper end and a lower end. The upper end of the lower section has a radially extending spring urged button. The lower end of the upper section has a radial aperture for selectively receiving the spring urged button. The button and aperture when separated configure the system for transportation and storage. The button and aperture when coupled configure the system for use. The lower end of the lower section has a threaded aperture. The upper end of the upper section has an axial aperture.

Next, an attachment component is provided. The attachment component has a circular cross sectional configuration along the majority of its length. The attachment component has an upwardly facing upper end with threads removably received in the threaded aperture. The attachment component has a central region in a spiral configuration with a diameter between 150 percent and 250 percent of the diameter of the linear rod. The attachment component has a downwardly facing lower end terminating in a point adapted to be received and secured in a bottom of a body of water.

A crank is next provided. The crank has a vertical lower region removably received and supported in the axial aperture of the upper section. The crank has a horizontal middle region. The crank has a vertical upper region adapted to be held by a user and rotated about the vertical axis of the linear rod.

Next, a cylindrical handle is provided. The handle rotatably receives the lower region of the crank adjacent to the middle region. The handle is adapted to be held by the user while the crank and the linear rod and the attachment component are rotated during use.

A grip is next provided. The grip is rotatably received on the upper section of the crank. The grip is adapted to be held by the user while the crank and the linear rod and the attachment component are rotated during use.

Next provided is a cylindrical collar. The cylindrical collar is secured to the lower region of the crank beneath the handle. The collar has a central recess of a diameter less than the diameter of the collar.

Lastly, a rope is provided. The rope has a first end secured around the central recess of the collar. The rope has a second end adapted to be secured to a cleat of a boat.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved boat anchoring system which has all of the advantages of the prior art boat anchoring systems and known designs and configurations and none of the disadvantages.

It is another object of the present invention to provide a new and improved boat anchoring system which may be easily and efficiently manufactured and marketed.

It is further object of the present invention to provide a new and improved boat anchoring system which is of durable and reliable constructions.

An even further object of the present invention is to provide a new and improved boat anchoring system which is susceptible of a low cost of manufacture with regard to both materials and labor, and which accordingly is then susceptible of low prices of sale to the consuming public, thereby making such boat anchoring system economically available to the buying public.

Even still another object of the present invention is to provide a boat anchoring system for securing the location of a boat in water as for fishing and the like, the securing being done in a safe, reliable and economical manner.

Lastly, it is an object of the present invention to provide a new and improved boat anchoring system having a cylindrical rod with an upper end having an upper aperture, a lower end with a lower aperture, and of a common diameter along the majority of its length. A spiral attachment component has an upwardly facing upper end received in the lower aperture and a downwardly facing lower end terminating in a point. A crank has a vertical lower region removably received in the upper aperture, a horizontal middle region, and a vertical upper region. A cylindrical collar is secured to the lower region of the crank. The collar has a central recess of a diameter less than the diameter of the collar. A rope has a first end secured around the central recess of the collar and a second end adapted to be secured to a cleat of a boat.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a rear elevational view of a boat anchoring system constructed in accordance with the principles of the present invention.

FIG. 2 is an enlarged rear elevational view of the system taken at Circle 2 of FIG. 1.

FIG. 3 is an enlarged rear elevational view of the system taken at Circle 3 of FIG. 1.

The same reference numerals refer to the same parts throughout the various Figures.

DESCRIPTION OF THE PREFERRED EMBODIMENT

Figure 4:
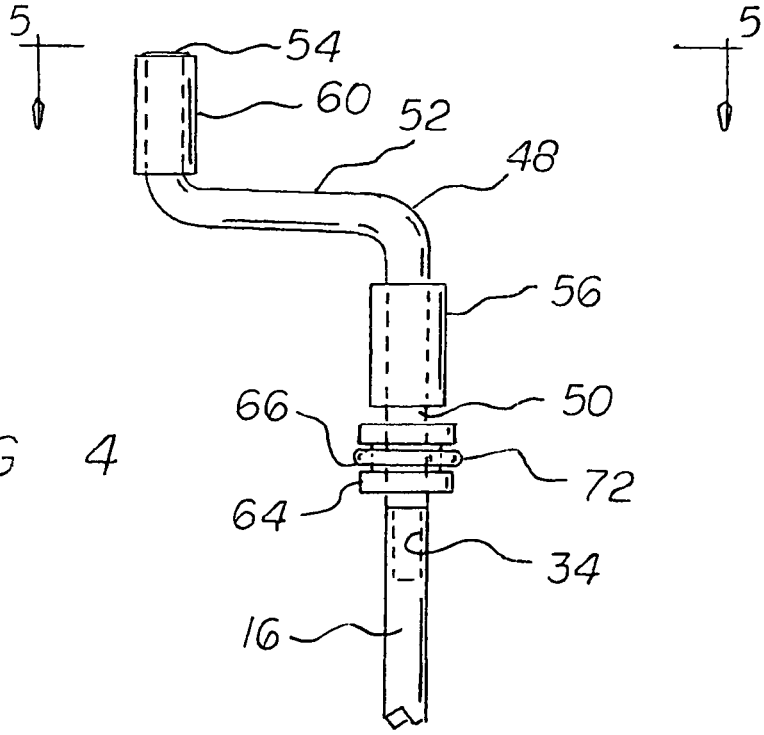
FIG. 4 is an enlarged side elevational view of the system taken along line 4-4 of FIG. 1.
Figure 5:
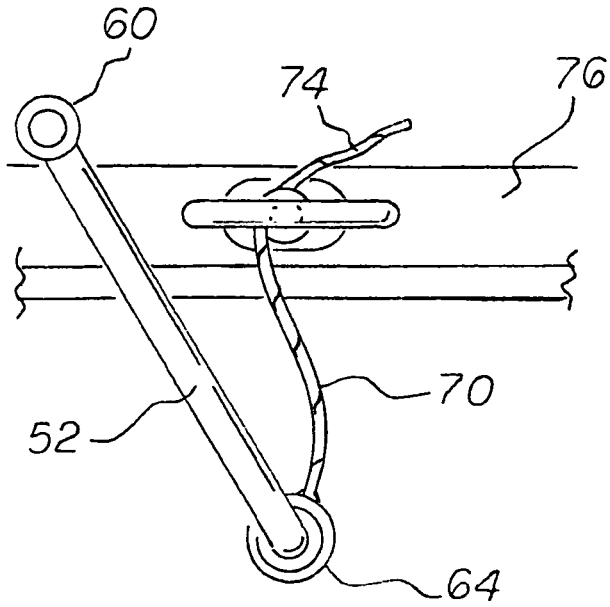
FIG. 5 is a plan view of the system taken along line 5-5 of FIG. 4.

With reference now to the drawings, and in particular to FIG. 1 thereof, the preferred embodiment of the new and improved boat anchoring system embodying the principles and concepts of the present invention and generally designated by the reference numeral 10 will be described.

The present invention, the boat anchoring system 10 is comprised of a plurality of components. Such components in their broadest context include a cylindrical rod, a spiral attachment component, a crank, a cylindrical collar and a rope. Such components are individually configured and correlated with respect to each other so as to attain the desired objective.

The boat anchoring system 10 is for securing the location of a boat in water as for fishing and the like. The securing is done in a safe, reliable and economical manner. First provided is an elongated linear rod 14 formed of a common diameter along a vertical axis. The linear rod includes an upper section 16 and a lower section 18. The upper section has an upper end 20 and a lower end 22. The lower section has an upper end 24 and a lower end 26. The upper end of the lower section has a radially extending spring urged button 28. The lower end of the upper section has a radial aperture 30 for selectively receiving the spring urged button. The button and aperture when separated configure the system for transportation and storage. The button and aperture when coupled configure the system for use. The lower end of the lower section has a threaded aperture 32. The upper end of the upper section has an axial aperture 34.

Next, an attachment component 38 is provided. The attachment component has a circular cross sectional configuration along the majority of its length. The attachment component has an upwardly facing upper end with threads 40 removably received in the threaded aperture. The attachment component has a central region 42 in a spiral configuration with a diameter between 150 percent and 250 percent of the diameter of the linear rod. The attachment component has a downwardly facing lower end terminating in a point 44 adapted to be received and secured in a bottom of a body of water.

A crank 48 is next provided. The crank has a vertical lower region 50 removably received and supported in the axial aperture of the upper section. The crank has a horizontal middle region 52. The crank has a vertical upper region 54 adapted to be held by a user and rotated about the vertical axis of the linear rod.

Next, a cylindrical handle 56 is provided. The handle rotatably receives the lower region of the crank adjacent to the middle region. The handle is adapted to be held by the user while the crank and the linear rod and the attachment component are rotated during use.

A grip 60 is next provided. The grip is rotatably received on the upper section of the crank. The grip is adapted to be held by the user while the crank and the linear rod and the attachment component are rotated during use.

Next provided is a cylindrical collar 64. The cylindrical collar is secured to the lower region of the crank beneath the handle. The collar has a central recess 66 of a diameter less than the diameter of the collar.

Lastly, a rope 70 is provided. The rope has a first end secured around the central recess of the collar. The rope has a second end 74 adapted to be secured to a cleat 76 of a boat.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A boat anchoring system comprising:

a cylindrical rod having an upper end with an upper aperture and a lower end with a lower aperture, the cylindrical rod having a common diameter along the majority of its length;

a spiral attachment component having an upwardly facing upper end received in the lower aperture, the attachment component having a downwardly facing lower end terminating in a point;

a crank having a vertical lower region removably received in the upper aperture, the crank having a horizontal middle region, the crank having a vertical upper region;

a cylindrical collar having a diameter and being secured to the lower region of the crank, the collar having a central recess of a diameter less than the diameter of the collar; and a rope having a first end secured around the central recess of the collar, the rope having a second end adapted to be secured to a cleat of a boat.

2. The system as set forth in claim 1 and further including:

a cylindrical handle rotatably receiving the lower region of the crank above the collar, the handle adapted to be held by a user while the crank and the cylindrical rod and the attachment component are rotated during use.

3. The system as set forth in claim 1 and further including:

a grip rotatably received in the upper region of the crank, the grip adapted to be held by a user while the crank and the cylindrical rod and the attachment component are rotated during use.

4. The system as set forth in claim 1 wherein the spiral attachment component has a circular cross sectional configuration along the majority of its length, the spiral attachment component having a central region in a spiral configuration with a diameter between 150 percent and 250 percent of the diameter of the cylindrical rod.

5. A boat anchoring system (10) for securing the location of a boat in water, the system comprising in combination:

an elongated linear rod (14) formed of a common diameter along a vertical axis and including an upper section (16) and a lower section (18), the upper section having an upper end (20) and a lower end (22), the lower section having an upper end (24) and a lower end (26), the upper end of the lower section having a radially extending spring urged button (28), the lower end of the upper section having a radial aperture (30) for selectively receiving the spring urged button, the button and aperture when separated configuring the system for transportation and storage, the button and aperture when coupled configuring the system for use, the lower end of the lower section having a threaded aperture (32), the upper end of the upper section having an axial aperture (34);

an attachment component (38) having a circular cross sectional configuration along the majority of its length, the attachment component having an upwardly facing upper end with threads (40) removably received in the threaded aperture, the attachment component having a central region (42) in a spiral configuration with a diameter between 150 percent and 250 percent of the diameter of the linear rod, the attachment component having a downwardly facing lower end terminating in a point (44) adapted to be received and secured in a bottom of a body of water;

a crank (48) having a vertical lower region (50) removably received and supported in the axial aperture of the upper section, the crank having a horizontal middle region (52), the crank having a vertical upper region (54) adapted to be held by a user and rotated about the vertical axis of the linear rod;

a cylindrical handle (56) rotatably receiving the lower region of the crank adjacent to the middle region, the handle adapted to be held by the user while the crank and the linear rod and the attachment component are rotated during use;

a grip (60) rotatably received on the upper section of the crank, the grip adapted to be held by the user while the crank and the linear rod and the attachment component are rotated during use;

a cylindrical collar (64) with a diameter and secured to the lower region of the crank beneath the handle, the collar having a central recess (66) of a diameter less than the diameter of the collar;

a rope (70) having a first end secured around the central recess of the collar, the rope having a second end (74) adapted to be secured to a cleat (76) of a boat.

* * * * *